US009840915B2

(12) United States Patent
Maîtrejean

(10) Patent No.: US 9,840,915 B2
(45) Date of Patent: Dec. 12, 2017

(54) TURBINE

(71) Applicant: EQUITHERM S.À R.L., Steinfort (LU)

(72) Inventor: Luc Maîtrejean, Virton (BE)

(73) Assignee: Equitherm S.À R.L., Steinfort (LU)

( * ) Notice: Subject to any disclaimer, the term of this patent is extended or adjusted under 35 U.S.C. 154(b) by 687 days.

(21) Appl. No.: 14/390,253

(22) PCT Filed: Apr. 2, 2013

(86) PCT No.: PCT/EP2013/056949
§ 371 (c)(1),
(2) Date: Oct. 2, 2014

(87) PCT Pub. No.: WO2013/150034
PCT Pub. Date: Oct. 10, 2013

(65) Prior Publication Data

US 2015/0044025 A1 Feb. 12, 2015

(30) Foreign Application Priority Data

Apr. 3, 2012 (LU) ..... 91970

(51) Int. Cl.
*F01D 5/04* (2006.01)
*F01D 1/28* (2006.01)

(52) U.S. Cl.
CPC ..... *F01D 5/04* (2013.01); *F01D 1/28* (2013.01); *F01D 5/041* (2013.01)

(58) Field of Classification Search
CPC ..... F01D 5/04; F01D 5/041; F01D 1/28
(Continued)

(56) References Cited

U.S. PATENT DOCUMENTS 1,870,212 A 8/1932 Lysholm et al.
2,066,788 A 1/1937 Lysholm
(Continued)

FOREIGN PATENT DOCUMENTS

DE 537917 C 11/1931
DE 611741 C 4/1935
(Continued)

*Primary Examiner* — Craig Kim
*Assistant Examiner* — Michael Sehn
(74) *Attorney, Agent, or Firm* — Reinhart Boerner Van Deuren P.C.

(57) ABSTRACT

A multi-stage turbine (16) is designed as an induction turbine with vapour induction in at least one intermediary stage. It is more particularly conceived as a radial-outward-flow type multi-stage turbine, with an axial main vapour inlet port (82) and an annular secondary vapour inlet port (84), which is arranged in the turbine (16) so as to annularly induce, in an intermediary stage of said turbine, a secondary vapour stream into an already partially expanded radial main vapour stream. The annular secondary vapour inlet port (84) comprises as a ring-zone (92) with through holes (94), which radially surrounds said axial main vapour inlet port (82) in a first turbine housing part (80). The axial vapour inlet port comprises a first tubular vapour inlet connection (82). The annular vapour inlet port comprises a second tubular vapour inlet connection (84) surrounding the first tubular vapour inlet connection (82), so as to define with the latter an annular space (86), wherein the ring-zone (92) with through holes (94) is arranged in this annular space (86).

13 Claims, 4 Drawing Sheets

(58) Field of Classification Search
USPC ..... 415/83, 64
See application file for complete search history.

(56) References Cited

U.S. PATENT DOCUMENTS

| | | | | |
|---|---|---|---|---|
| 2,200,288 | A | 5/1940 | Meininghaus | |
| 2,429,365 | A | 10/1947 | Möller | |
| 4,215,976 | A * | 8/1980 | Neumann | F03G 7/04 415/101 |

FOREIGN PATENT DOCUMENTS

| | | | |
|---|---|---|---|
| DE | 3406071 | A1 | 8/1984 |
| DE | 102007044625 | A1 | 4/2008 |
| GB | 403335 | A | 12/1933 |

* cited by examiner

TURBINE

TECHNICAL FIELD

The present invention generally relates to a turbine for expanding a pressurized vapour, in particular to a turbine with vapour induction in at least one intermediary turbine stage.

BACKGROUND ART

Due to the general necessity to reduce CO2 emissions and to the loss of trust in nuclear power plants, devices for producing electricity with low temperature sources are gaining of importance. Low temperature sources include e.g. industrial waste heat, low temperature geothermal heat sources, low temperature biomass energy and low temperature solar energy, but also novel low temperature heat generators based on chemical or nuclear reactions.

Such devices generally work according to a so-called Organic Rankine Cycle (ORC), i.e. a Rankine cycle in which the working fluid is an organic fluid with a lower evaporation temperature than water. The working principle underlying the ORC is basically the same as that of the classical Rankine cycle in which the working fluid is water. However, due to the lower evaporation temperature of the working fluid, the external heat source in an ORC may be in a lower temperature range than the external heat source in a Rankine cycle working with water.

Today, devices for power generation according to an ORC are commercially available mainly in a range starting with 0.3 MW electric power output, but there is an increasing need for such devices with a smaller electric power output too. In particular for the range of 25 kW to 250 kW electric (corresponding to a thermal recuperation range of about 150 kW to 1.5 MW), there seem to be interesting applications for producing electricity with low temperature sources using an ORC. However, with a decreasing nominal power of the device used for power generation, the investment costs per kW installed strongly increase and the efficiency of power generation decreases.

If the external heat source is connected into the ORC by means of a heat carrier medium, which has to be cooled down in an evaporator working as counter-current heat exchanger, it is known to operate an ORC with more than one evaporator. Each evaporator then works at a different evaporation pressure, i.e. with a different evaporation temperature, in combination either with a separate expansion machine for each evaporator or with a single multi-stage expansion machine, in which the vapour produced in each additional evaporator, is injected into an intermediate stage of the multi-stage expansion machine. Due to the fact that the heat transfer is split between evaporators working at different evaporation temperatures, one can work with a more important temperature differential on the side of the heat carrier medium, i.e. transform more heat into power.

ORC systems with more than one evaporator are e.g. described in DE 10 2007 044 625 A1 . According to a first embodiment, the system comprises several separate ORCs, each of these ORCs comprising an evaporator, a turbine, a condenser and a condensate pump. With regard to the heat carrier fluid, the evaporators are basically connected in series. With each evaporator is associated a turbine comprising its own housing with a nozzle system and blade wheels. These turbines are regrouped in pairs, wherein the blade wheels of a turbine pair have a common shaft. The parallel shafts of two turbine pairs are interconnected by a gear system to drive an electrical generator. Such a multi-turbine solution is of course expensive and cumbersome.

According to a second embodiment described in DE 10 2007 044 625 A1, the system comprises two evaporators associated with a two-stage turbine. This two-stage turbine comprises a rotor carrying two axially spaced blade rings, wherein the first blade ring has a smaller diameter than the second blade ring. A first steam flow (i.e. high pressure steam produced by a high pressure evaporator) radially enters into the turbine housing through a high pressure inlet and flows through a first annular channel radially into a first annular nozzle ring, which deflects the flow in an axial direction into the first rotor blade ring, i.e. the blade ring with the smaller diameter. A second steam flow (low pressure steam produced by a low pressure evaporator) radially enters into the turbine housing through a low pressure inlet and flows through a second annular steam channel into a second nozzle ring, which deflects the flow in an axial direction into the second rotor blade ring, i.e. the blade ring with the bigger diameter. The two stages are designed so as to achieve the same end pressure at the outlet of the first and second blade ring, wherein the exhaust streams are only merged in an outlet diffuser of the turbine. It is obvious that such a turbine has a rather low efficiency, when compared e.g. to a typical induction type turbine, i.e. a multi-stage axial turbine in which low pressure steam is induced into the main vapour stream at an intermediate turbine stage and both streams are thereafter commonly expanded. However, for power generation with an ORC in the kW-range, known induction type turbines are by far too expensive.

GB 403,335 and U.S. Pat. No. 1,870,212 show a radial-outward-flow type multi-stage turbine, with an axial main vapour inlet port and an annular secondary vapour inlet port, which is arranged in the turbine so as to annularly induce, in an intermediary stage of the turbine, a secondary vapour stream into an already partially expanded radial main vapour stream. The main vapour inlet port and the annular secondary vapour inlet port have to be separated by complicated labyrinth packaging, which makes the turbine rather expensive.

DE 537,917 shows a rather complicated design of a radial-flow type turbine, in which the rotor comprises axially spaced sets of stator/rotor assemblies, which are separated by separation walls and connected either in parallel or in series.

An object of the present invention is consequently to provide an induction type turbine, which can be produced at relatively low costs, and which has nevertheless good efficiency, so as to be e.g. an interesting solution for power generation with an ORC below 1 MW electric.

SUMMARY OF INVENTION

The present invention provides a turbine that is a radial-outward-flow type multi-stage turbine, with an axial main vapour inlet port and an annular secondary vapour inlet port, which is arranged in the turbine so as to annularly induce, in an intermediary stage of the turbine, a secondary vapour stream into an already partially expanded radial main vapour stream. The annular secondary vapour inlet port comprises a ring-zone with through holes, which radially surrounds said axial main vapour inlet port in a first turbine housing part. The axial vapour inlet port comprises a first tubular vapour inlet connection, and the annular vapour inlet port comprises a second tubular vapour inlet connection surrounding the first tubular vapour inlet connection, so as to define with the latter an annular space, wherein the ring-zone with through holes is arranged in this annular space.

It will be appreciated that—due to the design of the turbine as a radial-outward-flow type multi-stage turbine—the annular secondary vapour inlet port can be accommodated into the turbine very easily and, basically, without major additional costs. The manufacturing costs for the induction type turbine are not much higher than for a turbine with a single vapour inlet. Indeed, in such a turbine comprising several concentric rings of stator blades, an annular secondary vapour inlet port can be easily accommodated radially between two successive rings of stator blades. The annular configuration of the secondary vapour inlet port warrants low pressure losses at the secondary vapour induction and relatively small perturbations of the radial flow of the main vapour stream. The fact that each turbine stage of such a radial turbine may be easily accommodated to an increased vapour throughput—by simply increasing the height of the stator and rotor blades—makes this type of turbine particularly suitable for vapour induction in an intermediary turbine stage. The fact that the vapour is expanded in successive turbine stages with increasing diameters makes the turbine even more suitable for vapour induction in an intermediary stage. It will further be appreciated that a turbine in accordance with the present invention can be connected with a minimum of pressure losses to a high pressure and a low pressure vapour source.

In a preferred embodiment, the turbine comprises a substantially plate-shaped first housing part supporting the rings of stator blades. In this embodiment, the annular secondary vapour inlet port is advantageously formed in the first housing part as a ring-zone with through holes arranged between two successive rings of stator blades.

The turbine further comprises a rotor, which includes for each turbine stage, a ring of rotor blades radially surrounding a ring of stator blades. In a preferred embodiment, the annular secondary vapour inlet port opens onto an outer annular rim of a rotor ring, in which the rotor blades of a turbine stage are incorporated. This outer annular rim advantageously has a radial width decreasing towards its periphery, so as to form an annular (preferably concave) surface, for annularly deviating the secondary vapour stream, which flows through the annular secondary vapour inlet port, into a ring of stator blades of the next turbine stage, wherein it is merged with the already partially expanded main vapour stream. This embodiment warrants—at very reasonable costs—particularly low pressure losses at the secondary vapour induction and small perturbations of the radial flow of the main vapour stream.

In this preferred embodiment, the annular (preferably concave) surface, which is formed on the outer annular rim of the rotor ring, advantageously cooperates with an annular (preferably convex) surface, which is formed on a stator ring, in which the stator blades of the next turbine stage are incorporated, so as to define a ring-shaped converging nozzle for injecting the secondary vapour stream, which flows through the annular secondary vapour inlet port, into the ring of stator blades of the next turbine stage. This embodiment even further reduces—at very reasonable costs—pressure losses at the secondary vapour induction and results in still smaller perturbations of the radial flow of the main vapour stream.

This preferred embodiment of the turbine may further comprise a set of stator rings, with different diameters, with the stator blades incorporated therein, wherein the stator rings are removably fixed (e.g. with screws) on the first turbine housing part. Similarly, the turbine may further comprise a set of rotor rings, with different diameters, with the rotor blades incorporated therein, wherein these rotor rings are removably fixed (e.g. with screws) on a rotor disk. This embodiment allows accommodating the turbine or one or more turbine stages to a different vapour throughput by simply exchanging the stator and rotor rings. The turbine may be easily up-sized or down-sized, and it may be easily fine-tuned to specific working parameters. Hence, an optimal turbine efficiency may nearly always be warranted.

This preferred embodiment of the turbine may further comprise a stator exhaust ring radially surrounding the stator ring with the biggest diameter and being removably fixed on the first turbine housing part, wherein the stator exhaust ring defines vapour exhaust openings for discharging the expanded vapour stream. It may also comprise a substantially plate-shaped second turbine housing part including a shaft outlet neck and being removably fixed on the stator exhaust ring. In this preferred embodiment, a turbine shaft is rotatably supported within the shaft outlet neck; and the aforementioned rotor disk is supported in a cantilever manner by the turbine shaft, between the first turbine housing part and the second turbine housing part.

In this preferred embodiment, the first turbine housing part advantageously supports an end-cap, which forms a vapour inlet deflection surface opposite the axial main vapour inlet port the vapour inlet deflection surface, which is designed as a revolution surface centred on the central axis of the turbine. The stator blades of the first turbine stage are advantageously incorporated into this end-cap.

In this preferred embodiment, the second turbine housing part is advantageously equipped with mounting means for mounting it in a sealed manner in an opening of a container, so that a shaft outlet neck of the second turbine housing part is arranged outside the container, and the vapour exhaust openings for discharging the expanded vapour stream are arranged inside the container.

This preferred embodiment of the turbine may further include rolling contact bearings in the shaft outlet neck for supporting and locating the turbine shaft therein, and a shaft sealing device arranged adjacent to the rolling contact bearings, so that the rolling contact bearings are sealed from the vapour in the turbine. Hence, the shaft bearings may be rather standard rolling contact bearings, which are easily accessible outside the container for monitoring and maintenance purposes.

A preferred embodiment of the turbine may further comprise a first vapour drum that is located in axial extension of the axial main vapour inlet port and directly connected to the latter without any intermediate piping, and a second vapour drum that is located in axial extension of the annular secondary vapour inlet port and directly connected to the latter without any intermediate piping, wherein the second vapour drum is preferably a compartment inside the first vapour drum, or the first vapour drum is, more preferably, a compartment inside the second vapour drum. The axial vapour inlet port advantageously comprises a first tubular vapour inlet connection, which is engaged in a sliding and sealed manner by the first vapour drum, and the annular vapour inlet port advantageously comprises a second tubular vapour inlet connection surrounding the first tubular vapour inlet connection, wherein this second tubular vapour inlet connection is engaged in a sliding and sealed manner by the second vapour drum. Such combined low and high pressure vapour drums, which are connected without any intermediate piping and, preferably, with sliding connections to the turbine vapour inlets, reduce pressure losses at the vapour inlet(s) of the turbine, allow to easily achieve a superheating of the low pressure vapour by the high pressure vapour, thereby increasing efficiency of the Rankine cycle, make the device more compact, facilitate its assembling and reduce its costs.

BRIEF DESCRIPTION OF DRAWINGS

The afore-described and other features, aspects and advantages of the invention will be better understood with regard to the following description of an embodiment of the invention and upon reference to the attached drawings, wherein.

DETAILED DESCRIPTION OF AN EMBODIMENT OF THE INVENTION

It will be understood that the following description and the drawings to which it refers describe by way of example preferred embodiments of the claimed subject matter for illustration purposes. The description and drawings shall not further limit the scope, nature or spirit of the claimed subject matter.

Figure 2:
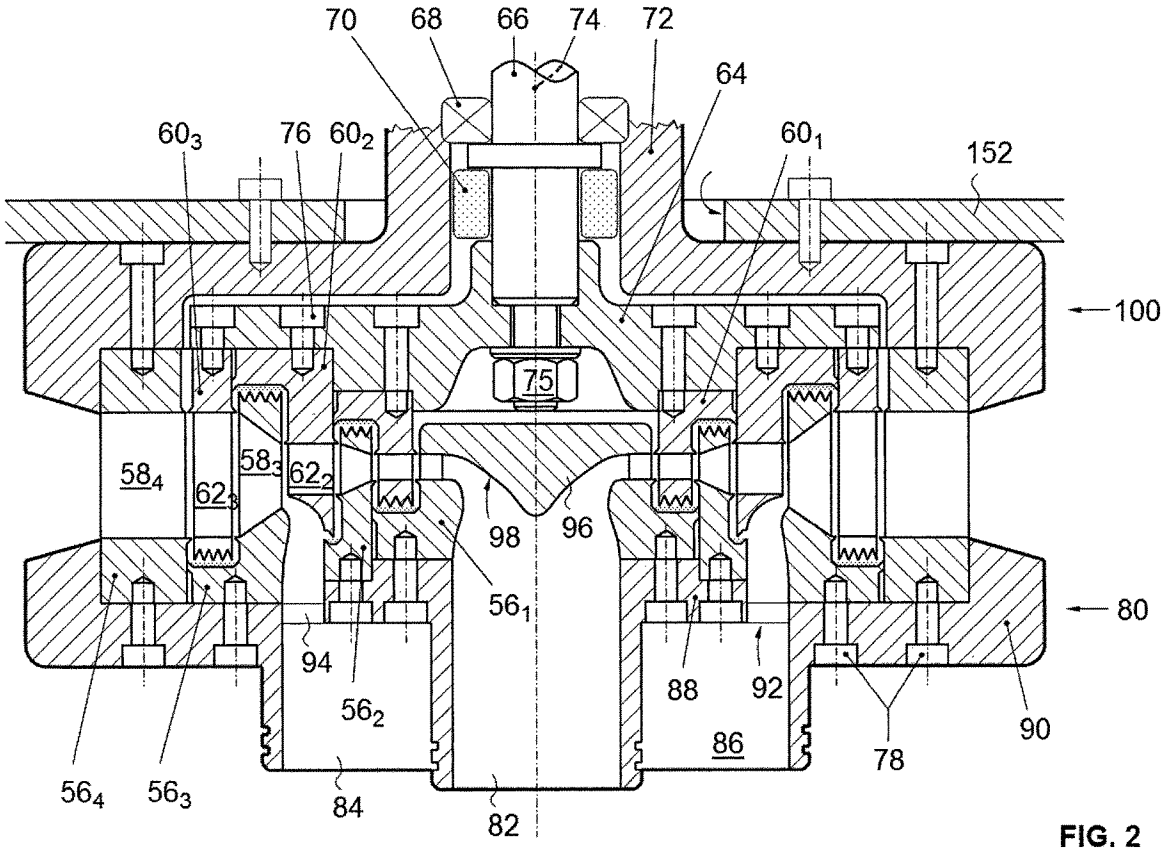
FIG. 2: is a schematic sectional view of a multi-stage turbine, in which low pressure vapour is induced at a low pressure turbine stage, wherein the section plane contains the central axis of the turbine.

FIG. 2 is a schematic cross-section through a turbine 16 in accordance with the present invention. It will first be noted that the turbine 16 is a multi-stage (here a three-stage) outward-flow radial type turbine, i.e. the vapour axially enters into the turbine 16 and then flows in a radial direction outward through the different stages of the turbine 16, which are substantially concentric. The turbine is furthermore of the induction type, i.e. a secondary flow of low pressure vapour is induced at a low pressure stage into the turbine 16. Finally, the turbine is of the impulse type, i.e. the vapour is mainly expanded as it passes through the stator of the turbine 16.

Figure 4:
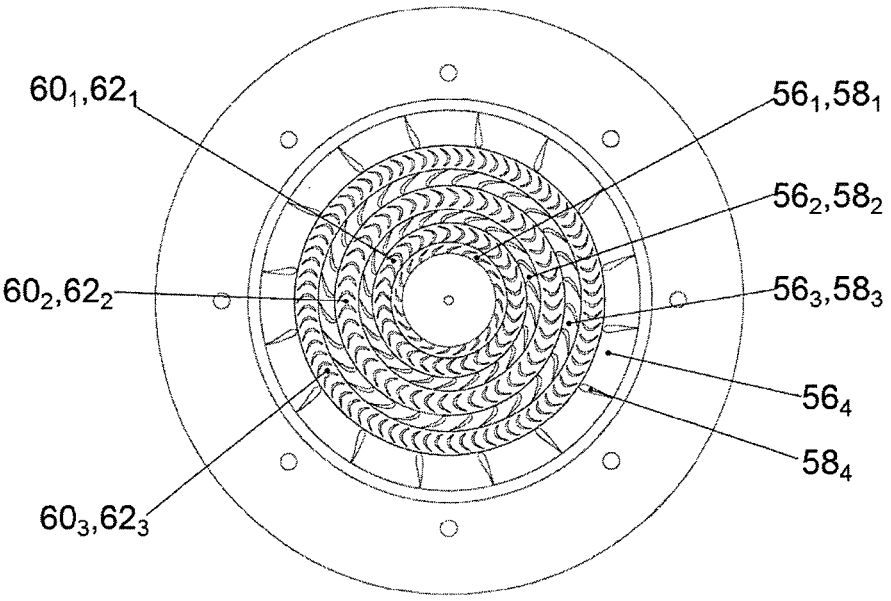
FIG. 4: is a schematic sectional view of a turbine as shown in FIG. 2, the section plane being this time perpendicular to the central axis of the turbine.

As best seen in the cross-section of FIG. 4, each of the three turbine stages comprises a stator ring $\mathbf{56}_1$, $\mathbf{56}_2$, $\mathbf{56}_3$, with increasing diameter and curved stator blades $\mathbf{58}_1$, $\mathbf{58}_2$, $\mathbf{58}_3$, and a rotor ring $\mathbf{60}_1$, $\mathbf{60}_2$, $\mathbf{60}_3$, with increasing diameter and curved rotor blades $\mathbf{62}_1$, $\mathbf{62}_2$, $\mathbf{62}_3$. The inlet stator ring $\mathbf{56}_1$ and the first rotor ring $\mathbf{60}_1$ form the first stage of the turbine 16. The second stator ring $\mathbf{56}_2$ and the second rotor ring $\mathbf{60}_2$ form the second stage of the turbine 16. The third stator ring $\mathbf{56}_3$ and the third rotor ring $\mathbf{60}_3$ form the third stage of the turbine 16. A fourth ring $\mathbf{56}_4$ surrounds the third or last stage of the turbine 16, to form a stator exhaust ring $\mathbf{56}_4$, with stator exhaust blades $\mathbf{58}_4$. It will of course be understood that the turbine 16 may also be designed with 4 stages or more, by adding one or more pairs of stator and rotor rings.

Referring now to FIG. 2 again, it will be noted that the rotor rings $\mathbf{60}_1$, $\mathbf{60}_2$, $\mathbf{60}_3$ are supported by a rotor disk 64, which is fixed to a free end of a turbine shaft 66. The turbine shaft 66 with the rotor disk 64 is rotatably supported in a cantilever fashion in a shaft outlet neck 72 by means of a bearing arrangement, preferably built up with rolling contact bearings. Reference number 68 points to a schematic representation of such a rolling contact bearing. Reference number 70 identifies a schematic representation of a sealing device, which seals the shaft 66 in the shaft outlet neck 72, between the rotor disk 64 and the bearing arrangement.

Reference number 74 identifies the central axis of the turbine shaft 66, which is also the central axis of all rotor rings $\mathbf{60}_1$, $\mathbf{60}_2$, $\mathbf{60}_3$ (and of all stator rings $\mathbf{56}_1$, $\mathbf{56}_2$, $\mathbf{56}_3$, $\mathbf{56}_4$), since all these rings are coaxial with the turbine shaft 66. It will be noted that the rotor disk 64 is axially secured to the turbine shaft 66, e.g. by means of a nut 75 or a screw (not shown), and that the torque is transmitted from the rotor disk 64 to the turbine shaft 66 by means of a form-fit or keyed assembly (not shown). The rotor rings $\mathbf{60}_1$, $\mathbf{60}_2$, $\mathbf{60}_3$ are fixed with screws 76 to the rotor disk 64, so that they are easily exchangeable.

Still referring to FIG. 2, the stator rings $\mathbf{56}_1$, $\mathbf{56}_2$, $\mathbf{56}_3$ are fixed with screws 78 to a plate-shaped first turbine housing part 80. This first turbine housing part 80 comprises a first and a second tubular vapour inlet connection 82, 84, a first and a second ring-shaped flange 88, 90 and a perforated ring zone 92. The first tubular vapour inlet connection 82 is centred on the central axis 74 of the turbine 16. The second tubular vapour inlet connection 84 surrounds the first tubular vapour inlet connection 82, so as to define with the latter an annular space 86, wherein the perforated ring zone 92 is contained in this annular space 86. The first ring-shaped flange 88 forms a shoulder around the first tubular vapour inlet connection 82. The second ring-shaped flange 90 forms a shoulder around the second tubular vapour inlet connection 84. The perforated ring zone 92 joins the first flange 88 and the second ring-shaped flange 90 and is provided with through-holes 94.

It will be noted that instead of being integral with the first turbine housing part 80, the first and/or second tubular vapour inlet connection 82, 84 could also be flanged to the first turbine housing part 80. In this case, the first turbine housing part 80 mainly consists of the first ring-shaped flange 88, the second ring-shaped flange 90 and the perforated ring zone 92, which joins the first and the second ring-shaped flange 88, 90. In this embodiment, the first ring-shaped flange 88 advantageously comprises a first connection means for flanging a removable first vapour inlet connection thereto, and the second ring-shaped flange 90 advantageously comprises a second connection means for flanging a removable second vapour inlet connection thereto (not shown in the drawings).

The first ring-shaped flange 88 supports the first and the second stator ring $\mathbf{56}_1$, $\mathbf{56}_2$. The first stator ring $\mathbf{56}_1$ is advantageously part of an end-cap 96, which forms a vapour inlet deflection surface 98 at the end of the first tubular vapour inlet connection 82. This vapour inlet deflection surface 98 is a revolution surface centred on the central axis 74 of the turbine 16, so as to annularly deflect the axial vapour stream in the first tubular vapour inlet connection 82 by 90° into the first stator ring $\mathbf{56}_1$.

The second ring-shaped flange 90 supports the third stator ring $\mathbf{56}_3$, as well as the exhaust stator ring $\mathbf{56}_4$. By means of the exhaust stator ring $\mathbf{56}_4$, the first turbine housing part 80 is fixed to a plate-shaped second turbine housing part 100. The rotor disk 64 with the rotor rings $\mathbf{60}_1$, $\mathbf{60}_2$, $\mathbf{60}_3$ is hereby located axially between the first housing part 80 and the second housing part 100. In the radial direction, the first rotor ring $\mathbf{60}_1$ is located between the first and the second stator ring $\mathbf{56}_1$and $\mathbf{56}_2$; the second rotor ring $\mathbf{60}_2$ is located between the second and the third stator ring $\mathbf{56}_2$ and $\mathbf{56}_3$; and the third rotor ring $\mathbf{60}_3$ is located between the third stator ring $\mathbf{56}_3$ and the exhaust stator ring $\mathbf{56}_4$. It will be appreciated that—with this sandwich design—the height of the stator blades $\mathbf{58}_1$, $\mathbf{58}_2$, $\mathbf{58}_3$ and rotor blades $\mathbf{62}_1$, $\mathbf{62}_2$, $\mathbf{62}_3$ can be modified, by simply exchanging the removable stator rings 56 and rotor rings 60. Consequently, with one size for the first and second turbine housing part 80 and 100, the rotor disk 64 and the turbine shaft 66, one may already cover a large range of pressures and flow rates. Thus, it will be e.g. be possible to cover the electric power range of 25 kW to 100 kW with one unique size for the first and second turbine housing part 80 and 100, the rotor disk 64 and the turbine shaft 66. In most cases it will even not be necessary to change the form of the rotor and stator blades 58, 62. A broad electric power range may be covered by simply changing the height of the rotor and stator blades 58, 62, all other geometric characteristics of the rotor and stator rings 56, 60 and blades 58, 62 remaining unchanged. Furthermore, if the available heat energy increases or decreases during lifetime of the turbine, the latter may be easily reconfigured for the new operating conditions by simply exchanging its rotor and stator rings 56, 60.

Figure 3:
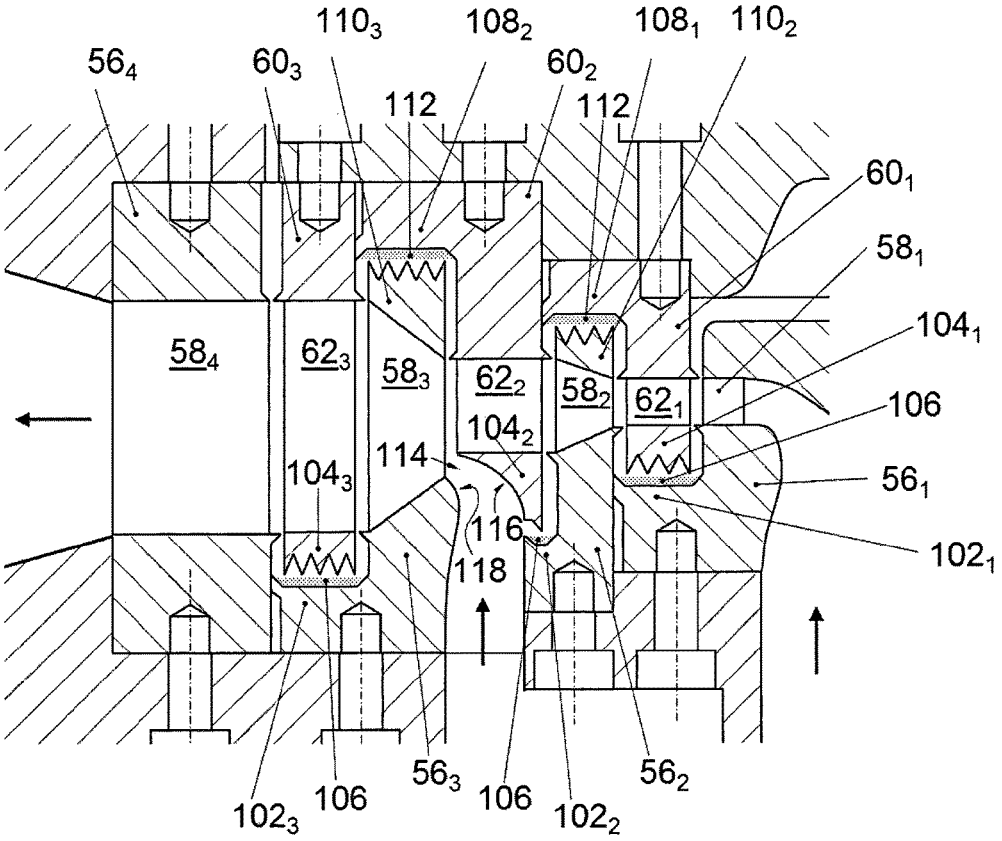
FIG. 3: is an enlarged detail of FIG. 2.

As is best seen in FIG. 3, each of the three stator rings $\mathbf{56}_1$, $\mathbf{56}_2$, $\mathbf{56}_3$ includes at its base an annular shoulder $\mathbf{102}_1$, $\mathbf{102}_2$, $\mathbf{102}_3$, which forms a labyrinth joint 106 with an opposite grooved surface located on an annular outer annular rim $\mathbf{104}_1$, $\mathbf{104}_2$, $\mathbf{104}_3$ of the corresponding rotor ring $\mathbf{60}_1$, $\mathbf{60}_2$, $\mathbf{60}_3$. Similarly, each of the first two rotor rings $\mathbf{60}_1$, $\mathbf{60}_2$ includes at its base an annular shoulder $\mathbf{108}_1$, $\mathbf{108}_2$, which forms a labyrinth joint 112 with an opposite grooved surface located on an annular outer annular rim $\mathbf{110}_2$, $\mathbf{110}_3$ of the corresponding stator ring $\mathbf{56}_2$, $\mathbf{56}_3$. Thus, vapour tightness in the radial direction between the rotating and stationary parts is solely achieved by easily machinable surfaces on the removal stator rings $\mathbf{56}_1$, $\mathbf{56}_2$, $\mathbf{56}_3$ and rotor rings $\mathbf{60}_1$, $\mathbf{60}_2$, and necessitates neither complicated machining on the turbine housing parts 80, 100 or the rotor disk 64, nor separate sealing elements. Furthermore, if the removable rotor and stator rings 56, 60 are replaced, all sealing surfaces in the turbine are replaced too. Alternatively, the removable stator rings $\mathbf{56}_1$, $\mathbf{56}_2$, $\mathbf{56}_3$ and rotor rings $\mathbf{60}_1$, $\mathbf{60}_2$, may be designed without the aforementioned annular shoulder, wherein the outer annular rims $\mathbf{104}_1$, $\mathbf{104}_2$, $\mathbf{104}_3$ of the rotor rings $\mathbf{60}_1$, $\mathbf{60}_2$, $\mathbf{60}_3$ and the outer annular rims $\mathbf{110}_2$, $\mathbf{110}_3$ of the stator rings $\mathbf{56}_2$, $\mathbf{56}_3$ cooperate directly with corresponding annular surfaces on the housing part 80 and the rotor disk 64 to form labyrinth joints.

It will further be noted that the annular shoulder $\mathbf{102}_2$ of the second stator ring $\mathbf{56}_2$ is smaller than the other two annular shoulders $\mathbf{102}_1$, $\mathbf{102}_3$, thereby leaving uncovered the through-holes 94 in the perforated ring zone 92 of the first turbine housing part 80. The width of the annular outer annular rim $\mathbf{104}_2$ of the second rotor ring $\mathbf{60}_2$, which is located just behind the perforated ring zone 92, decreases towards its periphery, so as to define with the opposite surface of the third stator ring $\mathbf{56}_3$ a ring-shaped converging nozzle 114, which is delimited, on one side, by an annular concave surface 116 defined by the second rotor ring $\mathbf{60}_2$ and, on the other side, by an annular convex surface 118 defined by the third stator ring $\mathbf{56}_3$. This ring-shaped nozzle 114 deflects the low pressure vapour stream, which flows from the annular space 86 in an axial direction through the through-holes 94, by an angle of 90° into the third stator ring $\mathbf{56}_3$. In this third stator ring $\mathbf{56}_3$, this low pressure vapour stream is induced into the main vapour stream that has already been expanded in the first and second stage of the turbine 16, so that both vapour streams have substantially the same pressure when they merge in the third stator ring $\mathbf{56}_3$.

Referring simultaneously to FIG. 2 and FIG. 3, it will be noted that the expansion of the vapour in the second stator ring $\mathbf{56}_2$ and the third stator ring $\mathbf{56}_3$ is mainly achieved by increasing the height of the stator blades 58 in the radial direction (i.e. the height of these blades at the outlet is considerably higher than their height at the inlet of the stator ring). Thus, the expansion of the vapour in these stator rings $\mathbf{56}_2$ and $\mathbf{56}_3$ is mainly determined by the increasing height of their blades. Consequently, for adapting the turbine to a different vapour throughput or a different inlet pressure in the turbine 16, it will not be necessary to entirely change the geometry of the rotor or stator blades 58, 62. It will most often simply be sufficient to change the height of the rotor and stator blades 58, 62, all other geometric characteristics of the rotor and stator rings 56, 60 and blades 58, 62 remaining basically unchanged.

It will be appreciated that the turbine as described hereinbefore may achieve an isentropic efficiency as high as 90%. Its rotation speed will preferably be limited to 18,000 rpm, so as to be capable of working with rolling contact bearings and common shaft sealing devices.

Figure 5:
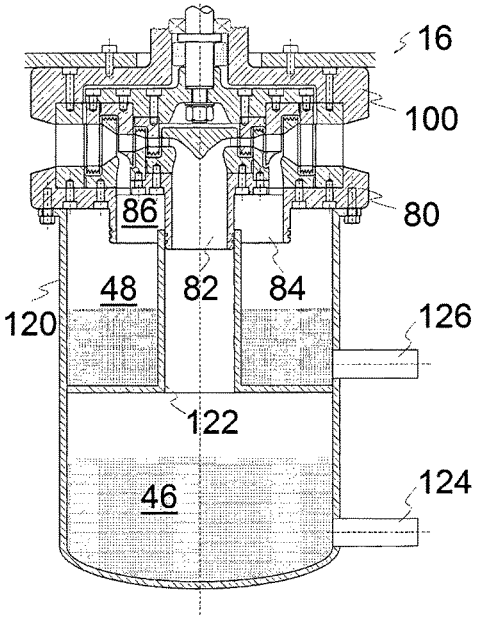
FIG. 5: is a schematic sectional view of the turbine as in FIG. 2, further schematically showing a first arrangement of a high pressure vapour drum and a low pressure vapour drum directly connected to the turbine.

FIG. 5 schematically shows a first arrangement of a high pressure vapour drum 46 and a low pressure vapour drum 48, both directly located under the turbine 16 and directly connected to latter without any intermediate piping. In the embodiment of FIG. 5, the high pressure vapour drum 46 is a cylindrical vessel directly flanged to the first turbine housing part 80. The low pressure vapour drum 48 forms an annular compartment within the high pressure vapour drum 46. This annular compartment is outwardly delimited by a cylindrical external wall 120 of the high pressure vapour drum 46 and inwardly delimited by a cylindrical internal wall 122. This cylindrical internal wall 122 engages the first tubular vapour inlet connection 82 of the turbine 16 in a sealed fit, wherein this sealed fit shall however be designed (e.g. with O-rings) to allow relative axial movement of the cylindrical internal wall 122 and the first tubular vapour inlet connection 82. The high pressure vapour flows through the axial passage delimited by the cylindrical internal wall 122 into the first tubular vapour inlet connection 82 of the turbine. The low pressure vapour flows directly from the annular low pressure vapour drum 48 into the annular space 86 delimited between the first tubular vapour inlet connection 82 and the second tubular vapour inlet connection 84 of the turbine. Reference number 124 points to a high pressure vapour inlet pipe connected laterally to the high pressure vapour drum 46, whereas reference number 126 points to a low pressure vapour inlet pipe connected laterally to the low pressure vapour drum 48.

Figure 6:
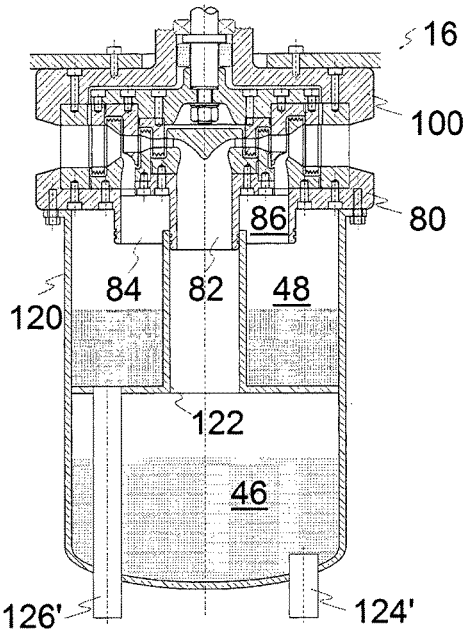
FIG. 6: is a schematic sectional view as in FIG. 5, showing a slightly modified embodiment.

The arrangement of FIG. 6 distinguishes over the arrangement of FIG. 5 mainly in that the low pressure vapour inlet pipe 126' traverses the high pressure vapour drum 46 to leave the latter through its bottom wall. This design necessitates that the low pressure vapour inlet pipe 126 and the high pressure vapour drum 46 may freely expand relative to one another. This can e.g. be achieved by connecting the low pressure vapour inlet pipe 126 by means of a bellow expansion joint (not shown) to the closed end of the high pressure vapour drum 46.

Figure 7:
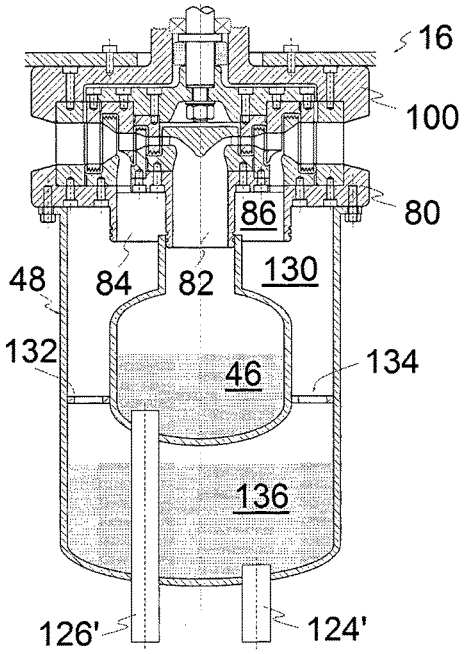
FIG. 7: is a schematic sectional view as in FIG. 5, showing a further possibility how to connect the high pressure vapour drum and the low pressure vapour drum to the turbine.

FIG. 7 shows a further arrangement of the high pressure vapour drum 46 and the low pressure vapour drum 48 connected to the turbine 16. The low pressure vapour drum 48 is a cylindrical vessel flanged to the first turbine housing part 80. The high pressure vapour drum 46 forms a cylindrical compartment within the low pressure vapour drum 48, separated from the outer wall of the latter by an annular space 130. It is vertically supported by a support flange 132, which is welded into the low pressure vapour drum 48. Through-openings 134 in the support flange 132 allow the intermediate pressure vapour to pass from an inlet compartment 136 of the low pressure vapour drum 48 into the annular space 130. The high pressure vapour drum 46 engages the first tubular vapour inlet connection 82 of the turbine 16 in a sealed way, wherein this sealed fit shall however be designed (e.g. with O-rings) to allow relative axial movement of the high pressure vapour drum 46 and the first tubular vapour inlet connection 82. Similarly as for the pipe 126' in the embodiment of FIG. 7, the passage of the pipe 124 through the bottom wall of the low pressure vapour drum 48 is designed for allowing a relative axial expansion of both components.

Figure 8:
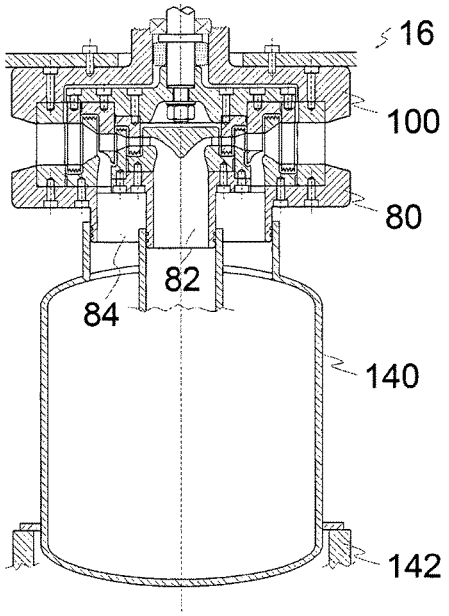
FIG. 8: is a schematic sectional view as in FIG. 5, showing an additional possibility how to connect the high pressure vapour drum and the low pressure vapour drum to the turbine.

It will be noted that in FIGS. 5, 6 and 7, the outer vessel is flanged to the first turbine housing part 80 of the turbine 16, and must consequently be able to axially expand away from the turbine 16. In FIG. 8, the outer vessel 140 is no longer flanged to the first turbine housing part 80 of the turbine 16. It simply engages the second tubular vapour inlet connection 84 of the turbine 16 in a sealed way, wherein this sealed fit is designed (e.g. with O-rings) to allow a relative axial movement of the outer vessel 140 and the second tubular vapour inlet connection 84. In this embodiment, the outer vessel 140 (which may be the high pressure vapour drum 46 as in FIG. 5 or 6, or the low pressure vapour drum 48 as in FIG. 7) can be vertically supported by a separate vertical support means 142. Thus, the outer vessel 140 may e.g. be directly supported on the first or second evaporator 12, 14, when the latter are axially arranged under the outer vessel 140. It will consequently be appreciated that in the embodiment of FIG. 7, the turbine 16 must not support the whole weight of the two vapour drums 46, 48.

It will be appreciated that in all three arrangements, the low pressure vapour is slightly superheated by contact with one or more walls of the high pressure vapour drum 46, which may be advantageous for the efficiency of the low pressure cycle. This superheating-effect is more important for the embodiment of FIG. 7 and may be further amplified by providing the outer wall of the inner cylinder 46 in FIG. 7 with fins.

Figure 1:
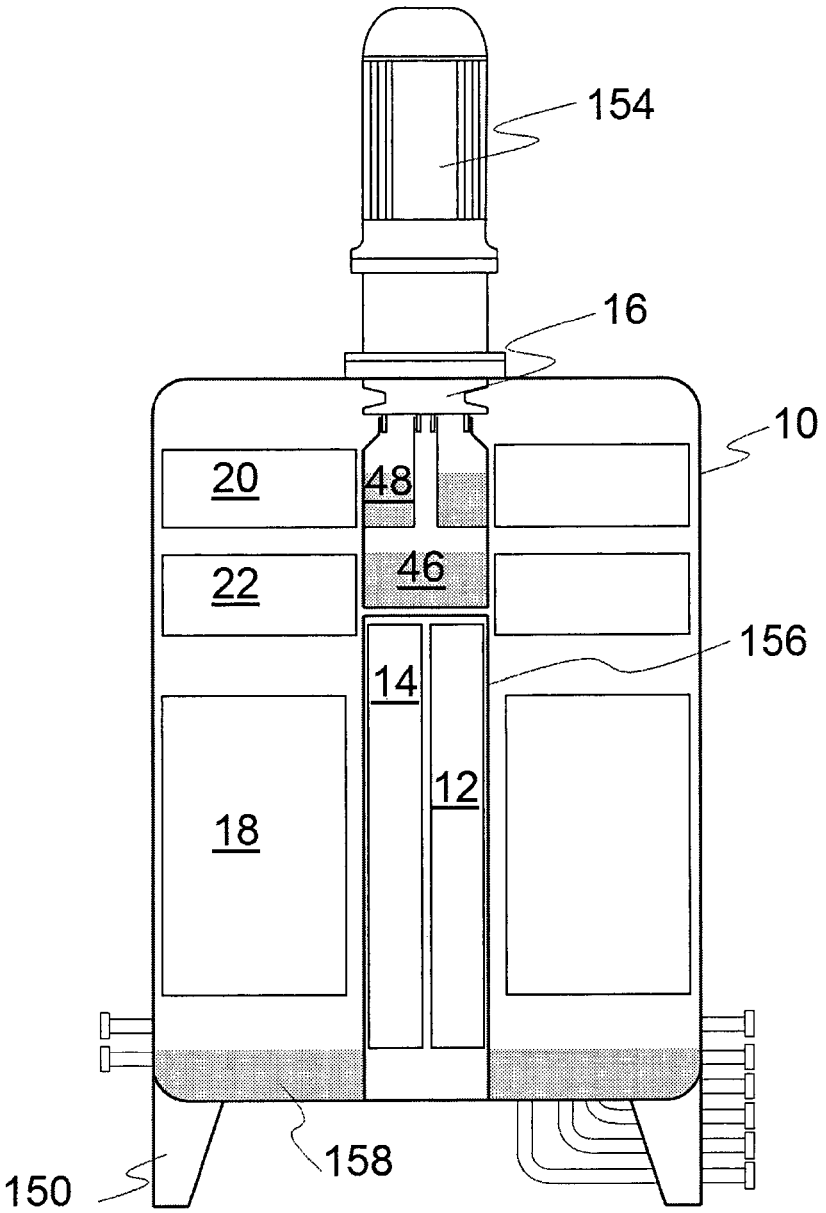
FIG. 1: is a schematic vertical sectional view of a container containing a turbine in accordance with the present invention and an arrangement of several heat exchangers.

FIG. 1 shows a compact device for electric power generation according to an improved ORC, more particularly, to an ORC working with two evaporators 12, 14, two regenerators 20, 22 and an induction turbine 16 according to the present invention. The container 10 is a vertical vapour tight cylinder supported on support feet 150. The turbine 16 is located inside the vertical cylinder 10, near the top end of the latter. The central axis 74 of the turbine is aligned with the central axis of the container 10. Referring back to FIG. 2, it will be noted that the second turbine housing part 100 is fixed with in a sealed manner to a head-plate 152, which is a part of the upper container wall. The shaft outlet neck axially protrudes out of an opening 153 of the head-plate 152. Alternatively, the second turbine housing part 100 may include an annular flange (not shown) with which it is fixed in a sealed manner onto a flange surrounding an axial opening (not shown) in the head of the container 10. In this case the entire second turbine housing part 100 is located outside the container 10. A generator 154 is arranged on the top of the vertical cylinder 10 and is coupled to the vertical shaft of the turbine 16. It will be appreciated that with this arrangement, the bearing arrangement 68 of the turbine shaft 66 is located completely outside the container 10, which greatly facilitates the design of its lubrication system, but also its maintenance.

The high pressure vapour drum 46 and the low pressure vapour drum 48 are arranged axially directly under the turbine 16. Both vapour drums 46, 48 are advantageously connected to the first and second tubular vapour inlet connection 82, 84 of the turbine 16 as described e.g. with reference to FIG. 5 or 6 and FIG. 8. The first evaporator 12 and the second evaporator 14 are arranged axially directly under the two vapour drums 46, 48, which can be vertically supported by the two evaporators 12, 14, as described with reference to FIG. 1. These two evaporators 12, 14 are preferably enclosed in a separate cylindrical compartment 156. The first and second regenerator 20, 22 are arranged annularly around the two vapour drums 46, 48, wherein the second regenerator 22 is arranged directly under the first regenerator 20. The condenser 18 is arranged annularly around the two evaporators 12, 14. The bottom part of the vertical cylinder 10 forms a condensate collector 158.

The turbine 16 radially discharges the expanded vapour through the stator exhaust ring 564 directly into the upper part of the vertical cylinder 10. An annular deflector (not shown) may be used to deflect the radially discharged vapour axially downwards. This annular deflector may be incorporated into the turbine 16 or be installed as a separate element into the container 10. The expanded vapour then passes downwards through the first and second regenerator 20, 22, to be finally condensed in the condenser 18. The condensate is collected in the condensate collector 158 at the bottom of the vertical cylinder 10.

Reference signs list

| | | | |
|---|---|---|---|
| 10 | container | 82 | first tubular vapour inlet connection |
| 12 | first evaporator | 84 | second tubular vapour inlet connection |
| 14 | second evaporator | 86 | annular space (between 82 and 84) |
| 16 | turbine | 88 | first ring-shaped flange (on 82) |
| 18 | condenser | 90 | second ring-shaped flange (on 84) |
| 20 | first regenerator | 92 | perforated ring zone |
| 22 | second regenerator | 94 | through-holes in 92 |
| 26 | electrical generator | 96 | end-cap |
| $56_1$, | first stator ring, | 98 | vapour inlet deflection surface |
| $56_2$, | second stator ring, | 100 | second turbine housing part (100) |
| $56_3$ | third stator ring | $102_1$, | annular shoulder on $56_1$, |
| $56_4$ | stator exhaust ring (58) | $56_2$, | |
| $58_1$, | curved stator blades (58) of $56_1$ | $102_2$, | $56_3$ |
| $58_2$, | curved stator blades (58) of $56_2$ | $102_3$ | |
| $58_3$ | curved stator blades (58) of $56_3$ | $104_1$, | annular outer annular rim on $60_1$, |
| $58_4$ | stator exhaust blades | $104_2$, | $60_2$, $60_3$ |
| $60_1$, | first rotor ring, | $104_3$ | |
| $60_2$, | second rotor ring, | 106 | labyrinth joint |
| $60_3$ | third rotor ring | | |
| $62_1$, | curved rotor blades of $60_1$ | | |
| $62_2$, | curved rotor blades of $60_2$ | | |
| $62_3$ | curved rotor blades of $60_3$ | | |
| 64 | rotor disk | | |

-continued

| Reference signs list | | | |
|---|---|---|---|
| 66 | turbine shaft | $108_1$, | annular shoulder on $60_1$, $60_2$ |
| 68 | bearing | $108_2$ | |
| 70 | sealing device | $110_2$, | annular outer annular rim on $56_2$, |
| 72 | shaft outlet neck | $110_3$ | $56_3$ |
| 74 | central axis of 16 | 112 | labyrinth joint |
| 75 | nut | 114 | ring-shaped nozzle |
| 76 | screws for rotor rings | 116 | annular concave surface defined by $60_2$ |
| 78 | screws for stator rings (56) | 118 | annular convex surface defined by $56_3$ |
| 80 | first turbine housing part (80) | 140 | outer vessel |
| 120 | cylindrical external wall | 142 | vertical support means |
| 122 | cylindrical internal wall | 150 | support feet |
| 124 | high pressure vapour inlet pipe | 154 | generator |
| 126 | low pressure vapour inlet pipe | 156 | separate cylindrical compartment |
| 130 | annular space | 158 | condensate collector |
| 132 | support flange | | |
| 134 | through openings in 132 | | |
| 136 | inlet compartment | | |

The invention claimed is:

1. A multi-stage turbine designed as an induction turbine with vapour induction in at least one intermediary stage; wherein:

said turbine is an radial-outward-flow type multi-stage turbine (16), with an axial main vapour inlet port (82) and an annular secondary vapour inlet port (84), which is arranged in said turbine (16) so as to annularly induce, in an intermediary stage of said turbine, a secondary vapour stream into an already partially expanded radial main vapour stream characterized in that:

said annular secondary vapour inlet port (84) comprises a ring-zone (92) with through holes (94), which radially surrounds said axial main vapour inlet port (82) in a first turbine housing part (80);

said axial vapour inlet port comprises a first tubular vapour inlet connection (82);

said annular vapour inlet port comprises a second tubular vapour inlet connection (84) surrounding said first tubular vapour inlet connection (82), so as to define with the latter an annular space (86); and said ring-zone (92) with through holes (94) is arranged in said annular space (86).

2. The turbine as claimed in claim 1, further comprising:

several concentric rings of stator blades (58);

wherein said annular secondary vapour inlet port (84) is accommodated radially between two successive rings (56) of stator blades (58).

3. The turbine as claimed in claim 2, wherein:

said turbine comprises a substantially plate-shaped first housing part (80) supporting said rings of stator blades (58);

said annular secondary vapour inlet port (84) is formed in said first housing part (80) as a ring-zone (92) with through holes (94) arranged between two successive rings (56) of stator blades (58).

4. The turbine as claimed in claim 2, further comprising:

a rotor (64) including for each turbine stage, a ring of rotor blades (62) radially surrounding a ring of stator blades (62); wherein:

said annular secondary vapour inlet port (84) opens onto an outer annular rim ($\mathbf{104_2}$) of a rotor ring ($\mathbf{60_2}$), in which said rotor blades ($\mathbf{62_2}$) of a turbine stage are incorporated, said outer annular rim ($\mathbf{104_2}$) having a radial width decreasing towards its periphery, so as to form an annular, preferably concave, surface (116), for annularly deviating said secondary vapour stream, which flows through said annular secondary vapour inlet port (84), into a ring of stator blades ($\mathbf{58_3}$) of the next turbine stage.

5. The turbine as claimed in claim 4, wherein:

said annular, preferably concave, surface (116) formed on said outer annular rim ($\mathbf{104_2}$) of said rotor ring ($\mathbf{60_2}$) cooperates with an annular, preferably convex, surface (118) formed on the stator ring ($\mathbf{56_3}$), in which said stator blades ($\mathbf{58_3}$) of the next turbine stage are incorporated, to define a ring-shaped converging nozzle (114) for injecting said secondary vapour stream flowing through said annular secondary vapour inlet port (84) into the ring of stator blades ($\mathbf{58_3}$) of the next turbine stage.

6. The turbine as claimed in claim 1, wherein said first housing part (80) is substantially plate-shaped.

7. The turbine as claimed in claim 1, further comprising:

a set of stator rings (56) with said stator blades (58) incorporated therein, said stator rings (56) being removably fixed on said first turbine housing part (80); and a set of rotor rings (60) with said rotor blades (62) incorporated therein, said rotor rings (60) being removably fixed on a rotor disk (64).

8. The turbine as claimed in claim 7, further comprising:

a stator exhaust ring ($\mathbf{56_4}$) radially surrounding the stator ring ($\mathbf{56_3}$) with the biggest diameter and being removably fixed on said first turbine housing part (80), said stator exhaust ring ($\mathbf{56_4}$) defining vapour exhaust openings for discharging the expanded vapour stream;

a substantially plate-shaped second turbine housing part (100) including a shaft outlet neck (72), said second turbine housing part (100) being removably fixed on said stator exhaust ring (58);

a turbine shaft (66) rotatably supported within said shaft outlet neck (72); said rotor disk (64) being supported in a cantilever manner by said turbine shaft (66) between said first turbine housing part (80) and said second turbine housing part (100).

9. The turbine as claimed in claim 8, wherein said first turbine housing part (80) supports an end-cap (96), which forms a vapour inlet deflection surface (98) opposite said axial main vapour inlet port (82), said vapour inlet deflection surface (98) being a revolution surface centred on said central axis (74) of the turbine (16), wherein said stator blades (58) of the first turbine stage are incorporated into said end-cap (96).

10. The turbine as claimed in claim 8, wherein:

said second turbine housing part (100) is equipped with mounting means for mounting it in a sealed manner in an opening of a container (10), so that a shaft outlet neck (72) of said second turbine housing part (100) is arranged outside said container (10), and said vapour exhaust openings for discharging the expanded vapour stream are arranged inside said container (10).

11. The turbine as claimed in claim 10, further including:

rolling contact bearings in said shaft outlet neck (72) for supporting and locating said turbine (16) shaft therein; and a shaft sealing device arranged adjacent to said rolling contact bearings, so that said rolling contact bearings are sealed from the vapour in the turbine (16).

12. The turbine as claimed in claim 1 , further comprising: a first vapour drum (46) that is located in axial extension of said axial main vapour inlet port (82) and directly connected to the latter without any intermediate piping; and a second vapour drum that is located in axial extension of said annular secondary vapour inlet port (84) and directly connected to the latter without any intermediate piping;

wherein said second vapour drum (48) is a compartment inside said first vapour drum (46), or said first vapour drum (46) is a compartment inside said second vapour drum (48).

13. The turbine as claimed in claim 12, wherein:

said axial vapour inlet port comprises a first tubular vapour inlet connection (82), which is engaged in a sliding and sealed manner by said first vapour drum (46); and said annular vapour inlet port comprises a second tubular vapour inlet connection (84) surrounding said first tubular vapour inlet connection; and said second tubular vapour inlet connection is engaged in a sliding and sealed manner by said second vapour drum (48).

* * * * *